United States Patent [19]

Nesbit et al.

[11] Patent Number: 4,984,787

[45] Date of Patent: Jan. 15, 1991

[54] ILLUMINATED BASKETBALL BASKET RIM AND ILLUMINATED BASKETBALL BACKBOARD

[76] Inventors: Charles E. Nesbit, 9206 Willard Ct., Des Moines, Iowa 50322; Mark S. Nesbit, 1248 17th, West Des Moines, Iowa 50265

[21] Appl. No.: 501,680

[22] Filed: Mar. 30, 1990

Related U.S. Application Data

[63] Continuation of Ser. No. 327,597, Mar. 23, 1989.

[51] Int. Cl.[5] ..... A63B 63/08

[52] U.S. Cl. ..... 273/1.5 R; 315/360

[58] Field of Search ..... 273/1.5 R, 55 D, 424, 273/DIG. 24; 315/360

[56] References Cited

U.S. PATENT DOCUMENTS

| | | | |
|---|---|---|---|
| 2,568,279 | 9/1951 | Franz et al. | 273/DIG. 24 X |
| 3,215,912 | 11/1965 | Bruno | 273/1.5 R X |
| 3,825,261 | 7/1974 | Zapos | 273/55 D |
| 3,918,719 | 11/1975 | Welch | 273/DIG. 24 X |
| 4,204,149 | 5/1980 | Cleary et al. | 315/360 X |
| 4,248,010 | 2/1981 | Fox | 273/424 X |
| 4,361,767 | 11/1982 | Pelka et al. | 315/360 X |
| 4,425,532 | 1/1984 | Sinkauz | 315/360 |
| 4,431,196 | 2/1984 | Kutnyak | 273/424 |
| 4,461,977 | 7/1984 | Pierpont et al. | 315/360 X |
| 4,492,049 | 1/1985 | Gaylor | 273/1.5 R X |
| 4,500,795 | 2/1985 | Hochstein et al. | 315/360 X |
| 4,736,955 | 4/1988 | Pollock | 273/DIG. 24 X |
| 4,846,475 | 7/1989 | Newcomb et al. | 273/DIG. 24 X |
| 4,858,920 | 8/1989 | Best | 273/1.5 R |

FOREIGN PATENT DOCUMENTS

| | | | |
|---|---|---|---|
| 2446465 | 9/1980 | France | 273/DIG. 24 |

OTHER PUBLICATIONS

Porter Athletic Equipment Co. Catalog 2-1961, p. 5.

*Primary Examiner*—Paul E. Shapiro
*Attorney, Agent, or Firm*—Henderson & Sturm

[57] ABSTRACT

A basketball basket rim having an illumination light that combined with an illuminated basketball backboard would aid those involved with the sport when used in low light areas and areas without lighting systems.

6 Claims, 4 Drawing Sheets

ILLUMINATED BASKETBALL BASKET RIM AND ILLUMINATED BASKETBALL BACKBOARD

This is a continuation of co-pending application Ser. No. 07/327,597 filed on Mar. 23, 1989.

TECHNICAL FIELD

This invention relates to the game of basketball and more particularly to illuminated basketball baskets which are sometimes referred to as the hoop or the goal.

The basketball backboard would also incorporate an illuminating light source.

BACKGROUND ART

There are many prior art devices related to the development of the game of basketball. There are also many prior art devices related to the illumination of basketball courts and arena's. One problem associated with the prior art devices where the basketball basket, is concerned is that at night the basket becomes hard to see because of its height above the ground compared to most outdoor home lighting systems. Also if a person wanted to play basketball at night, and there where no outdoor lighting means, by being able to illuminate the basketball backboard and basket rim the players would be able to play the game.

Those concerned with these and other problems recognize the need for an improved illuminated basketball basket and backboard.

DISCLOSURE OF THE INVENTION

The present invention provides an illuminated basketball basket and backboard. The rim of the basket would house an illuminating light source such as a string of lights, fiber optics or any other type of light known in the art.

The lighting system for the basket would be encased inside of the rim for protection from the elements and from the basketball itself. The basketball rim could be manufactured of metal with a hollow interior into which the illuminating light source would be installed.

The conventional metal basketball rim would have cut outs around the rims circumference which would allow the light source to shine through the cut outs located along the basket rim and would have transparent protection covers or coverings which help to protect the lighting system.

The basketball backboard would have illuminating means molded into its construction or mounted behind the backboard itself which would have to be manufactured of a semi-transparent or transparent material for the illuminating light source to be useful.

The power source for illuminating the basketball rim and backboard would be either A/C, D/C or Solar or any combination of these.

In another embodiment, the basket rim would be manufactured of transparent synthetic materials which would allow the illuminating light source housed inside of the rim to shine through.

An object of the present invention is the provision of an improved illuminated basketball basket rim prewired with lights or fiber optics.

Another object of the present invention is to provide an illuminated basketball backboard and illuminated basket rim that are rugged and will stand up to abuse.

A further object of the present invention is to provide an illuminated basketball backboard and basket rim that are easy to use.

Still another object of the present invention is the availability of different illuminating colors.

A still further object of the present invention is to provide switching ability so that the illuminated basketball backboard and illuminated basket rim lighting can be turned on and off.

Yet another object of the present invention is the provision of an illuminated basketball backboard and an illuminated basket rim that are inexpensive to manufacture.

BRIEF DESCRIPTION OF THE DRAWINGS

These and other attributes of the invention will become more clear upon a thorough study of the following description of the preferred embodiments for carrying out the invention, particularly when reviewed in conjunction with the drawings wherein:

FIG. 4 is a perspective view of a standard basketball rim equipped with cut outs to allow illuminating means to shine through.

BEST MODE FOR CARRYING OUT THE INVENTION

Figure 1:
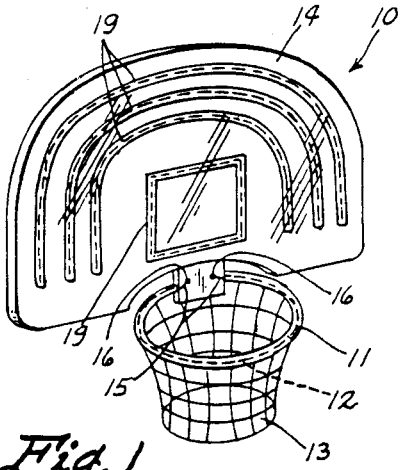
FIG. 1 is a perspective view of an illuminated basketball backboard with an attached illuminated basket rim.

Referring now to the drawings, wherein like reference numerals designate identical or corresponding parts throughout the several views, FIG. 1 shows the basketball backboard and basket generally at 10. The illumination lighting (12) is housed inside the transparent basket rim (11) the wiring (15) passes through openings (16). Shown on the front of the backboard (14) are illumination means (19).

Figure 2:
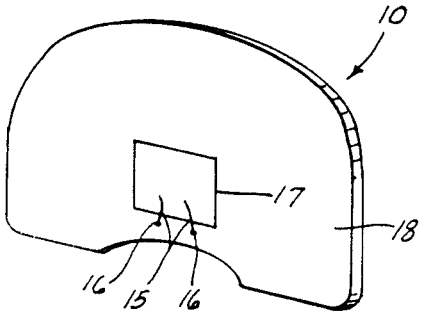
FIG. 2 is a perspective view of the backside of an illuminated basketball backboard and rim showing a power source location.

FIG. 2 shows the backside of the basketball backboard (18) with a power source container (17) mounted to the backboard (18) the illumination wiring (15) passes through openings (16) and connect to the power source (17).

Figure 3:
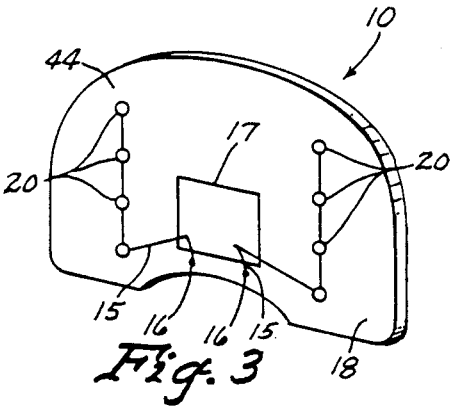
FIG. 3 is a perspective view of the backside of a basketball backboard showing another type of illuminating means mounted to the backside of a transparent basketball backboard.

FIG. 3 shows the backside view of a basketball backboard (18) with a power source container (17) that supplies power for the illumination lighting (20) which is mounted on the backside of the backboard (18) the wiring (15) connects the power source (17) with the illuminating means (20) the backboard would be transparent (44) to allow for illumination from behind.

Figure 4:
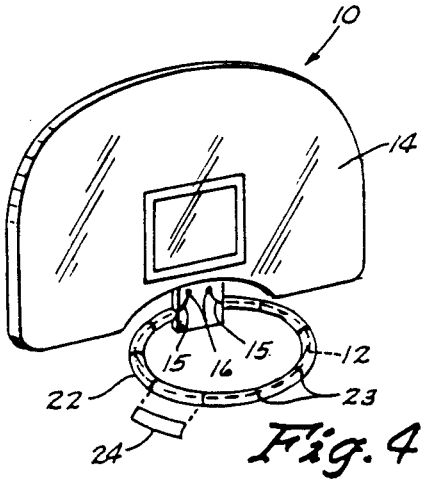

FIG. 4 shows a backboard generally at (10) the front of the backboard (14) and a metal basket rim (22) having a hollow interior housing an illumination means (12).

The metal basket rim (22) would have cut out openings around its circumference to allow the illumination lighting (12) to shine through. The cut out (23) would have transparent covers or coverings (24) to protect the illumination lighting (12).

Figure 5:
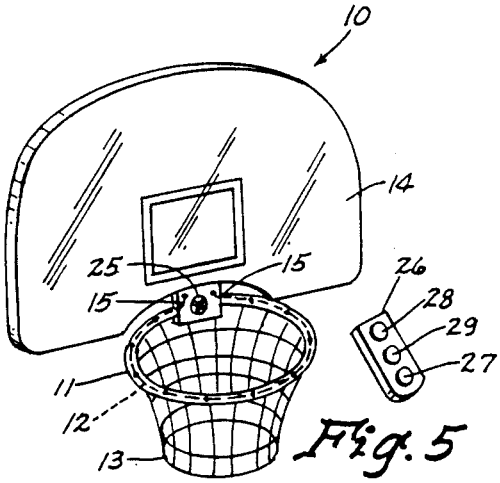
FIG. 5 is a perspective view of a remote control system installed to control the illuminating functions of the illuminated basketball backboard and illuminated basket rim.

FIG. 5 shows a backboard generally at (10) the front of the backboard (14) and a remote control unit (26) with an on button (28) an off button (29) and a dimmer control (27). A remote control receiver (25) is mounted to the backboard (14) illumination lighting (12) is housed inside the transparent basket rim (11).

Figure 6:
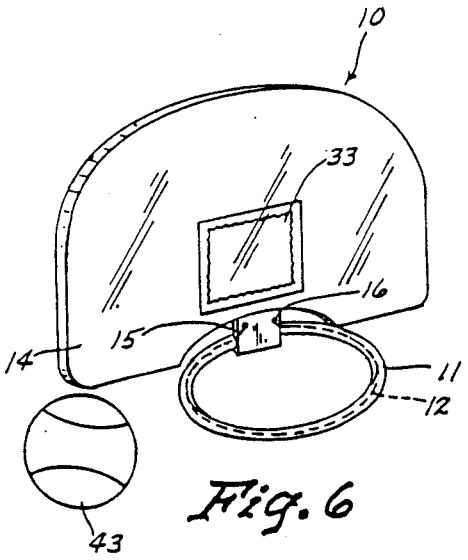
FIG. 6 is a perspective view of a pressure activated switch control system mounted to a illuminated basketball backboard.

FIG. 6 shows the basketball backboard generally at (10) the front of the backboard (14) and a pressure switch contact (33) located on the backboard front (14) the pressure switch contact (33) would turn on the illumination lighting (12) when an object such as a basketball (43) were to hit the backboard front (14). If no contact is made by the basket ball (43) for a determined time span the power source (17) would shut off power to the illuminating means.

Figure 7:
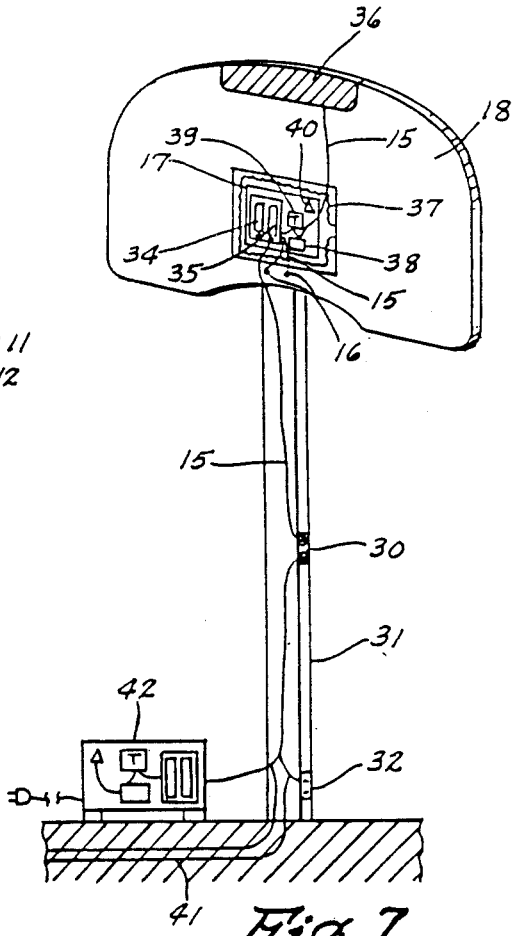
FIG. 7 is a perspective view of the backside of an illuminated basketball backboard and illuminated basket rim power source and mounting system.

FIG. 7 shows the backside of a backboard (18) the power source container (17) would be waterproof and mounted to shock absorbent buffer material (37). Housed inside the power source container would be a battery compartment (34) with batteries (35) inside. A transformer (39) a rechargeable battery (38) and a timer would all interconnect and would be housed inside the power source container (17). A solar collector (36) connects by wiring (15) to the power source (17). A pole mount (31) would incorporate a on/off switch (30) on the pole (31) a recharging plug-in (32) connects by wiring (15) to the power source (17) buried underground wiring (41) could also be used to supply power to the power source container (17). An optional waterproof ground based power source (42) could also be used and would eliminate the power source container (17) mounted to the rear side of the backboard (18). It is to be understood that the optional ground based power source (42) would provide all of the same features of the power source container (17).

Thus it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

We claim:

1. In a basketball backboard and basketball rim combination an improvement comprising:

an illumination means in the form of illumination lights contained within both the basketball rim and portions of the basketball backboard wherein both said rim and backboard are provided with transparent surfaces that will permit the transmission of light from the said illumination lights; and switching means for controlling the on/off actuation of said illumination lights; wherein, the switching means includes pressure sensitive means located on the face of the backboard for controlling the on/off actuation of said illumination lights.

2. The improvement as in claim 1; wherein, the switching means further comprises time delay means operatively associated with said pressure sensitive means for controlling the on/off actuation of said illumination lights.

3. In a basketball backboard and basketball rim combination an improvement comprising:

an illumination means in the form of illumination lights contained within the basketball rim wherein said rim is provided with transparent surfaces that will permit the transmission of light from the said illumination lights; and switching means for controlling the on/off actuation of said illumination lights; wherein, the switching means including pressure sensitive means located on the face of the backboard for controlling the on/off actuation of said illumination lights.

4. The improvement as in claim 3; wherein, the switching means further comprises time delay means operatively associated with said pressure sensitive means for controlling the on/off actuation of said illumination lights.

5. In a basketball backboard and basketball rim combination an improvement comprising:

an illumination means in the form of illumination lights contained within portions of the basketball backboard wherein said backboard is provided with transparent surfaces that will permit the transmission of light from the said illumination lights; and switching means for controlling the on/off actuation of said illumination lights; wherein, the switching means includes pressure sensitive means located on the face of the backboard for controlling the on/off actuation of said illumination lights.

6. The improvement as in claim 5; wherein, the switching means further comprises time delay means operatively associated with said pressure sensitive means for controlling the on/off actuation of said illumination lights.

* * * * *